US007386898B1

(12) United States Patent
Brun

(10) Patent No.: US 7,386,898 B1
(45) Date of Patent: Jun. 17, 2008

(54) SLEEPING BAG

(76) Inventor: Andreas Brun, Hardstrasse 81, Zurich (CH) 8004

( * ) Notice: Subject to any disclaimer, the term of this patent is extended or adjusted under 35 U.S.C. 154(b) by 327 days.

(21) Appl. No.: 10/049,454

(22) PCT Filed: Aug. 2, 2000

(86) PCT No.: PCT/IB00/01295

§ 371 (c)(1),
(2), (4) Date: Dec. 8, 2004

(87) PCT Pub. No.: WO01/12029

PCT Pub. Date: Feb. 22, 2001

(30) Foreign Application Priority Data

Aug. 12, 1999 (DE) ..... 299 13 921 U

(51) Int. Cl.
*A47G 9/08* (2006.01)

(52) U.S. Cl. ..... 5/413 R; 2/69.5

(58) Field of Classification Search ..... 5/413 R, 5/502; 2/69.5
See application file for complete search history.

(56) References Cited

U.S. PATENT DOCUMENTS 3,837,021 A * 9/1974 Sellers et al. ..... 5/502
3,988,791 A 11/1976 Simon
5,249,323 A 10/1993 Kikuchi et al.
5,483,713 A * 1/1996 Kikuchi et al. ..... 5/502
6,754,918 B1 * 6/2004 Lap ..... 5/413 R
7,094,714 B2 * 8/2006 Lap et al. ..... 442/1

* cited by examiner

*Primary Examiner*—Michael Trettel
(74) *Attorney, Agent, or Firm*—Lackenbach Siegel, LLP; Andrew F. Young, Esq.

(57) ABSTRACT

The invention relates to a sleeping bag consisting of adjacent chambers that are formed by partition walls. The chambers contain a filling material. The sleeping bag also consist of a zip and inner and outer linings which cover the chambers. The outer lining consist of a waterproof material. The outer lining and the partition walls or the outer lining and fixing stripes being connected to the partition walls consist of a material that can be sealed. The partition walls are sealed onto the outer lining from the inside at the end of said walls or by means of the fixing strips.

16 Claims, 1 Drawing Sheet

SLEEPING BAG

CROSS REFERENCE TO THE RELATED APPLICATIONS

This application claims priority to PCT/IB00/01295 filed Aug. 2, 2000, which in turn claims priority from DE 299 13 9211.2 filed Aug. 12, 1999.

BACKGROUND OF THE INVENTION

1. Field of the Invention

This invention concerns a sleeping bag constructed of side by side chambers formed by dividing walls and filled with stuffing material, inner and outer shells that cover the chambers and a zipper.

2. Description of the Related Art

Sleeping bags designed for various purposes have been available in many different styles for a long time. When sleeping outdoors (without a tent), it is desirable to have protection from dampness and wetness caused by rain, dew, or snow. For this reason, sleeping bags are available with waterproof outer shells.

One example in current use is Super Dryloft from Gore, a membrane made of stretched Gore-Tex that is laminated onto nylon. Stretching the membrane increases the membrane's water vapor-permeability. However, it is moisture resistant and completely windproof. Micro-fiber fabrics, such as Pertex nylon, are used for less demanding requirements. Although these sleeping bags are essentially waterproof, they exhibit weak spots, especially in places where there are external seams.

In order to address this issue, it has been proposed to equip sleeping bags with separate outer coverings (like that available under the trade name C-tex) under which is located a cover made of vapor-permeable laminate. However, this necessitates carrying and packing an additional item.

OBJECTS AND SUMMARY OF THE INVENTION

The purpose of this invention is to create a waterproof sleeping bag, the resistance characteristics of which are improved and with which it is unnecessary to carry additional item.

This purpose is fulfilled with the features described in the independent claims. The additional claims detail the inventions' characteristics and further developments.

According to the invention, a sleeping bag consists of side by side chambers formed by dividing walls and filled with stuffing material, inner and outer shells that cover the chambers, and a zipper. The sleeping bag is characterized by the outer shell, which is made of a waterproof material; the outer shell and dividing walls or the outer shell and the attachment strips (bonded to the dividing walls), which consist of a weldable or glueable material; and the dividing walls, which are welded or glued at their ends or through the use of attachment strips to the inside of the outer shell. If dividing walls are used that are not weldable or glueable, these will be sewn to the attachment strips. It is preferable for the sleeping bag to have a waterproof zipper or a zipper that is covered with a waterproof outer flap, whereby, it is preferable for the outer flap to be welded or bonded to the outer shell.

It is preferable for the outer shell and the attachment strips to be constructed from a thermoplastic material like PVC or polyurethane or from a fabric that is coated with these materials. For welding, any material may be used that can be welded using common methods (high frequency welding, hot air welding, hot sealing with the use of welding aids, heated wedge pressure welding, heat-pulse welding, radiant heat welding).

In order to maintain convection and promote evaporation, the dividing walls should be constructed of materials like tricot or mosquito netting fabric. The inner shell will be constructed preferably in the common manner from cotton, nylon fabric, or polyester fabric, in other words, a breathable textile and the dividing walls are sewn up with this material at their other, inner ends. The filling will be down or synthetic fibers as is common.

The following will more closely describe an example of the invention with the help of a drawing.

DETAILED DESCRIPTION OF THE PREFERRED EMBODIMENTS

Figure 1:
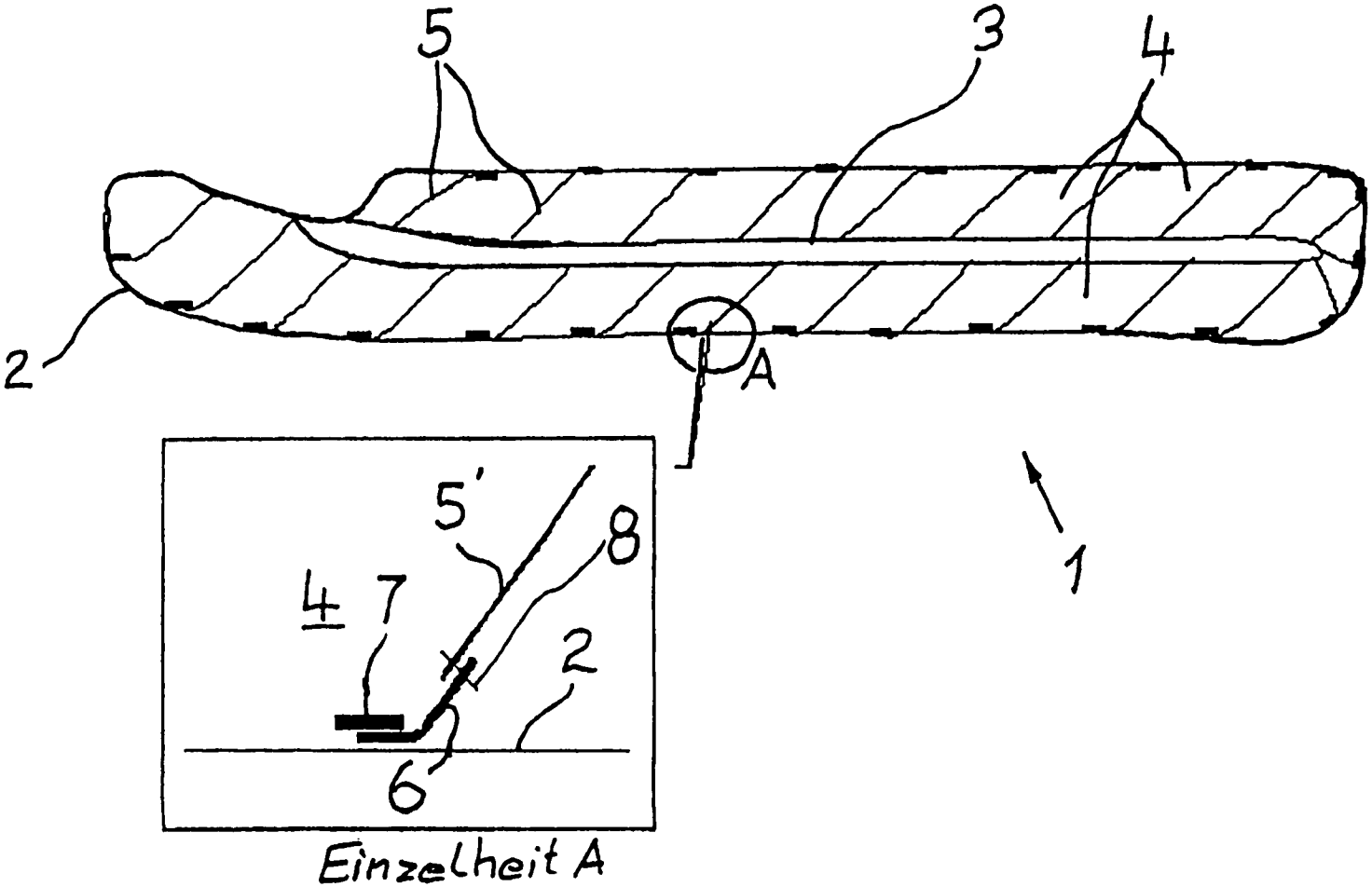
FIG. 1 is a side view of a sleeping bag construction with adjacent chambers and a section Detail A.

Referring now to FIG. 1, a schematic section through a sleeping bag 1 is shown with an outer shell 2 and an inner shell 3. Chambers 4 are arranged between the outer shell 2 and the inner shell 3. The chambers are divided by the dividing walls 5. The chambers 4 are filled with down or synthetic fibers. Inside, the dividing walls 5 are sewn to the inner shell 3. Refer to the enlarged detail A to view the connection to the outer shell 2.

The dividing wall 5, which may consist of mosquito netting, is sewn to a weldable attachment strip 6 via a seam 8. The attachment strip 6 rests on the inside end of the outer shell 2, which is also constructed of a weldable material. The attachment strip and outer shell are joined by a band of weldable material 7 like polyurethane, which overlaps the end of the attachment strip 6 and is welded in place.

This construction produces an external shell 2 that is completely unbroken externally has no seams, no abrasion-prone glue spots, or externally-located welding bands. In contrast to supplemental outer materials or separate covers the design produces no noticeable increase in weight. If side seams or similar are present, these can be covered in the normal way with welded bands if it is not possible to avoid them with overlapping welds.

The invention claimed is:

1. A sleeping bag comprising:

an inner shell;

an outer shell, said outer shell being made of a waterproof material and having an inner surface and an outer surface;

a plurality of dividing walls attached separately to said inner shell and said inner surface of said outer shell;

said inner shell, said outer shell, and said plurality of dividing walls defining a plurality of insulating chambers;

a fusion at each said plurality of dividing wall's interface with said inner surface of said outer shell, said fusion creating no substantial diminution of said outer shell's waterproof property and no breach of said outer shell's continuity;

a sleeping compartment defined by a folding of a plurality of insulating chambers, whereby sides of said sleeping compartment are partially joined by one of a temporary attachment, a permanent attachment, and an adjustable attachment; wherein:

said temporary attachment includes at least one of:

a waterproof zipper, a zipper with a waterproof outer flap, and a waterproof outer flap.

2. A sleeping bag comprising:

an inner shell;

an outer shell, said outer shell being made of a waterproof material and having an inner surface and an outer surface;

a plurality of dividing walls attached separately to said inner shell and said inner surface of said outer shell;

said inner shell, said outer shell, and said plurality of dividing walls defining a plurality of insulating chambers;

a fusion at each said plurality of dividing wall's interface with said inner surface of said outer shell, said fusion creating no substantial diminution of said outer shell's waterproof property and no breach of said outer shell's continuity;

a sleeping compartment defined by a folding of a plurality of insulating chambers, whereby sides of said sleeping compartment are partially joined by one of a temporary attachment, a permanent attachment, and an adjustable attachment; wherein:

said permanent attachment is waterproof and is at least one of:

a waterproof outer flap formed by an attachment member, and a waterproof seam.

3. A sleeping bag comprising:

an inner shell;

an outer shell, said outer shell being made of a waterproof material and having an inner surface and an outer surface;

a plurality of dividing walls attached separately to said inner shell and said inner surface of said outer shell;

said inner shell, said outer shell, and said plurality of dividing walls defining a plurality of insulating chambers;

a fusion at each said plurality of dividing wall's interface with said inner surface of said outer shell, said fusion creating no substantial diminution of said outer shell's waterproof property and no breach of said outer shell's continuity;

a sleeping compartment defined by a folding of a plurality of insulating chambers, whereby sides of said sleeping compartment are partially joined by one of a temporary attachment, a permanent attachment, and an adjustable attachment; wherein said adjustable attachment is waterproof and is at least one of:

a zipper, and a zipper with a waterproof outer flap.

4. A sleeping bag, comprising:

a zipper;

a waterproof outer shell having an inner and an outer surface;

an inner shell having an inner surface and an outer surface;

a plurality of side by side chambers defined by dividing walls extending between said outer shell and said inner shell;

said dividing walls having respective outer shell ends attached to said inner surface of said outer shell by a means for attaching outer shell ends;

said dividing walls having respective inner shell ends attached to said inner surface of said outer shell by said means for attaching inner shell ends; and said means for attaching outer shell ends includes at least one of a direct attachment means for directly attaching to said inner surface of said outer shell, and an attachment strip means for attaching to said inner surface of said outer shell with an attachment strip, whereby said outer surface of said outer shell remains unbroken externally.

5. A sleeping bag, according to claim 4, wherein:

said direct attachments means includes at least one of a means of a bonding, a welding, a gluing, and a sealing of said outer shell ends to said inner surface of said outer shell.

6. A sleeping bag, according to claim 4, wherein:

said attachment strip means includes at least one attachment strip fixed between said outer shell end of said dividing wall and said inner surface of said outer shell.

7. A sleeping bag, according to claim 6, wherein:

said at least one attachment strip is at least one of a weldable, a bondable, and a sealable material; and said attachment strip means includes at least one of a means for bonding, a welding, a gluing, and a sealing of a portion of said attachment strip to said inner surface of said outer shell.

8. A sleeping bag, according to claim 7, further comprising:

at least one band of weldable material overlapping portions of said at least one attachment strip and said inner surface of said outer shell, thereby enabling said attachment strip means.

9. A sleeping bag, according to claim 8, wherein:

said at least one band of weldable material including a polyurethane material, a PVC material, and a fabric that is coated with one of PVC and polyurethane.

10. A sleeping bag, according to claim 6, wherein:

said attachment strip is fixed to said outer shell end of said dividing wall by sewing.

11. A sleeping bag, according to claim 4, wherein:

said outer shell is a thermoplastic material.

12. A sleeping bag, according to claim 11, wherein:

said thermoplastic material is at least one of a PVC, a polyurethane, and a fabric coated with one of a PVC and a polyurethane.

13. A sleeping bag, according to claim 4, wherein:

said inner shell is a breathable textile.

14. A sleeping bag, according to claim 13, wherein:

said breathable textile is one of a cotton textile, a nylon fabric, a polyester fabric.

15. A sleeping bag, according to claim 4, wherein:

said dividing walls are constructed from a flexible material enabling convection and promotion of evaporation.

16. A sleeping bag, according to claim 15, wherein:

said flexible material enabling convection and promotion of evaporation is one of a tricot flexible material and a mosquito netting material.

* * * * *